US005936185A

United States Patent [19]

Tokuni

[11] Patent Number: 5,936,185

[45] Date of Patent: Aug. 10, 1999

[54] MINE DISPOSAL DEVICE AND DISPOSAL METHOD

[75] Inventor: Hachiroda Tokuni, Kanagawa-ken, Japan

[73] Assignee: Yoshio Fukai, Kanagawa-ken, Japan

[21] Appl. No.: 09/025,153

[22] Filed: Feb. 18, 1998

[51] Int. Cl.[6] ..... B64D 1/04; B65G 9/00

[52] U.S. Cl. ..... 89/1.13; 89/1.13; 102/402

[58] Field of Search ..... 89/1.13, 1.11, 89/1.1

[56] References Cited

U.S. PATENT DOCUMENTS

| | | | |
|---|---|---|---|
| 2,489,349 | 11/1949 | White | 89/1.13 |
| 2,500,970 | 3/1950 | Walker | 89/1.13 |
| 2,509,163 | 5/1950 | Musselman | 89/1.13 |
| 4,590,844 | 5/1986 | Bar-Nefy et al. | 89/1.13 |
| 4,938,114 | 7/1990 | Mathew et al. | 89/1.13 |
| 5,189,243 | 2/1993 | Hambric | 89/1.13 |
| 5,313,868 | 5/1994 | Wolf | 89/1.13 |
| 5,442,990 | 8/1995 | Krohn | 89/1.13 |

*Primary Examiner*—Charles T. Jordan
*Assistant Examiner*—Jeffrey Howell
*Attorney, Agent, or Firm*—Browdy and Neimark

[57] ABSTRACT

A mine disposal device comprises an automatically guided tractor with a stabilizer provided in front of the tractor. The stabilizer has a plurality of soil pulverizing rotor disks, and a solid semi-cylindrical shield covering the upper half of the rotor disks. Front and rear movable skirts are rotatably attached the shield. A sled, touching the surface of the land, is attached to the shield and keeps constant the depth of soil pulverized by the rotor disks. The front and rear movable skirts are opened, forward and backward, by the blasts of the antipersonnel mines. The blast force works against the resilient forces of front and rear shock absorbers. Each of the front and rear movable skirts is bent such that a top portion faces outside of the shield.

9 Claims, 5 Drawing Sheets

MINE DISPOSAL DEVICE AND DISPOSAL METHOD

BACKGROUND OF THE INVENTION

1. Field of the Invention

The present invention relates to a land mine disposal device and a mine disposal method, and especially, relates to an inexpensive device which can dispose antipersonnel mines safely.

2. Prior Art

At present, in every corner of the world, especially in the Third World, a large number of land mines are still laid. Since there are little number of accurate records to show the places where mines are laid, the mine disposal is extremely difficult, and unfortunate and miserable accidents happen repeatedly. In the Third World, there are a large number of lands which cannot be used as a farmland because the mine disposal is incomplete.

The land mines are traditionally detected by a metal detector and then disposed. However, since a lot of antipersonnel mines do not have sufficient metals to which the metal detector can react, there are a large number of cases where the mines cannot be detected by the metal detector. An approach for disposing the antipersonnel mines by running a large-sized automatic guided bulldozer in a land where the personnel mines may be laid has been also attempted. But this approach is not practical because it requires a large sum of costs to revive the land as a farmland after such a disposal has been performed.

SUMMARY OF THE INVENTION

It is, therefore, an object of the present invention to provide an inexpensive mine disposal device which can dispose antipersonnel mines safely.

It is another object of the present invention to provide a safe disposal method of antipersonnel mines.

It is a further object of the present invention to provide a mine disposal device which can reduce cost of reviving the land as a farmland after a mine disposal has been performed.

DESCRIPTION OF THE PREFERRED EMBODIMENT

Figure 1:
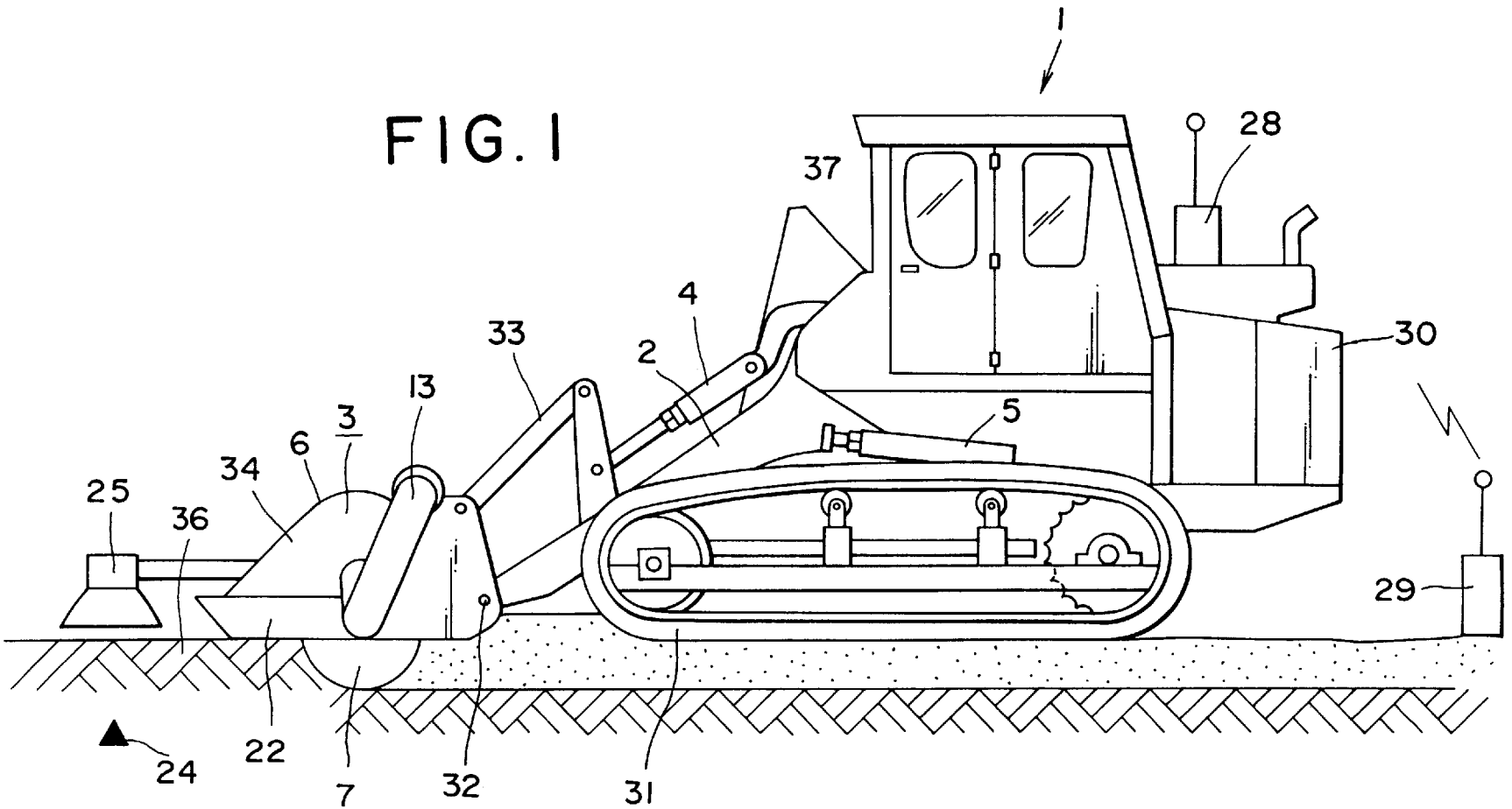
FIG. 1 is a side view showing a tractor with a stabilizer for the mine disposal according to the present invention.
Figure 2:
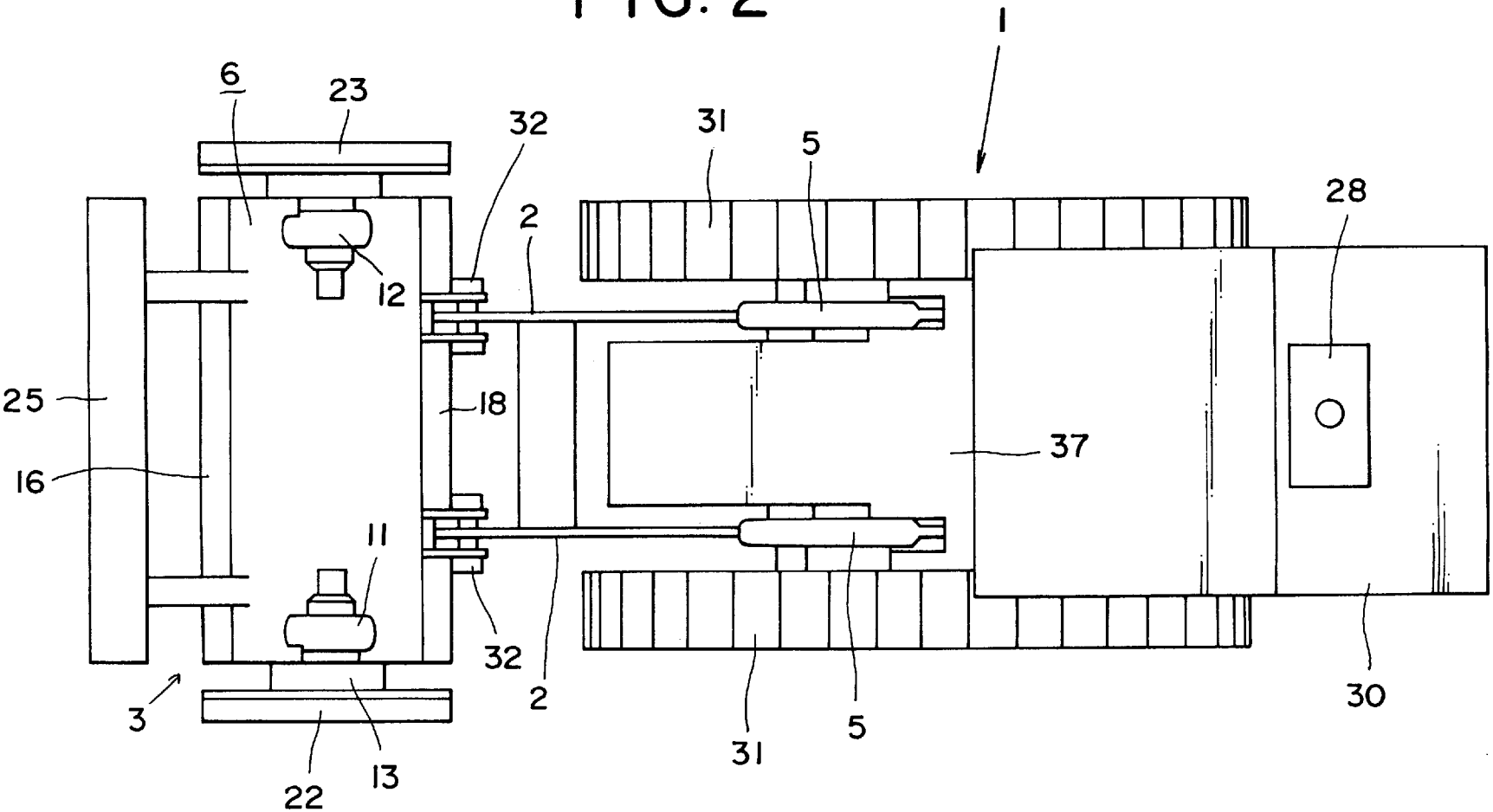
FIG. 2 is a plan view of the tractor.

An embodiment of the present invention will be described by referring to drawings. A tractor 1 has an engine 30 and a crawler or a wheel 31 driven to rotate by the power of the engine 30. Each rear end of supporting arms 2 is rotatably attached to a vehicle body 37 of the tractor 1. To front ends of the supporting arms 2 projecting beyond a front side of the body 37, an attachment or a shank-type stabilizer 3 for mine disposal is rotatably attached with mounting shafts 32. The stabilizer 3 is also connected to the supporting arms 2 through a linkage 33. The stabilizer 3 is substantially vertically moved by the action of hydraulic cylinders 5 mounted between the body 37 and the arms 2, and further, it is rotated about the shafts 32 by the action of hydraulic cylinders 4 mounted between the body 37 and the linkage 33. The tractor 1 with the crawler 31 shows an excellent performance in running on a soft land or a slope land, and can run on almost all lands where mines may be laid.

Figure 3:
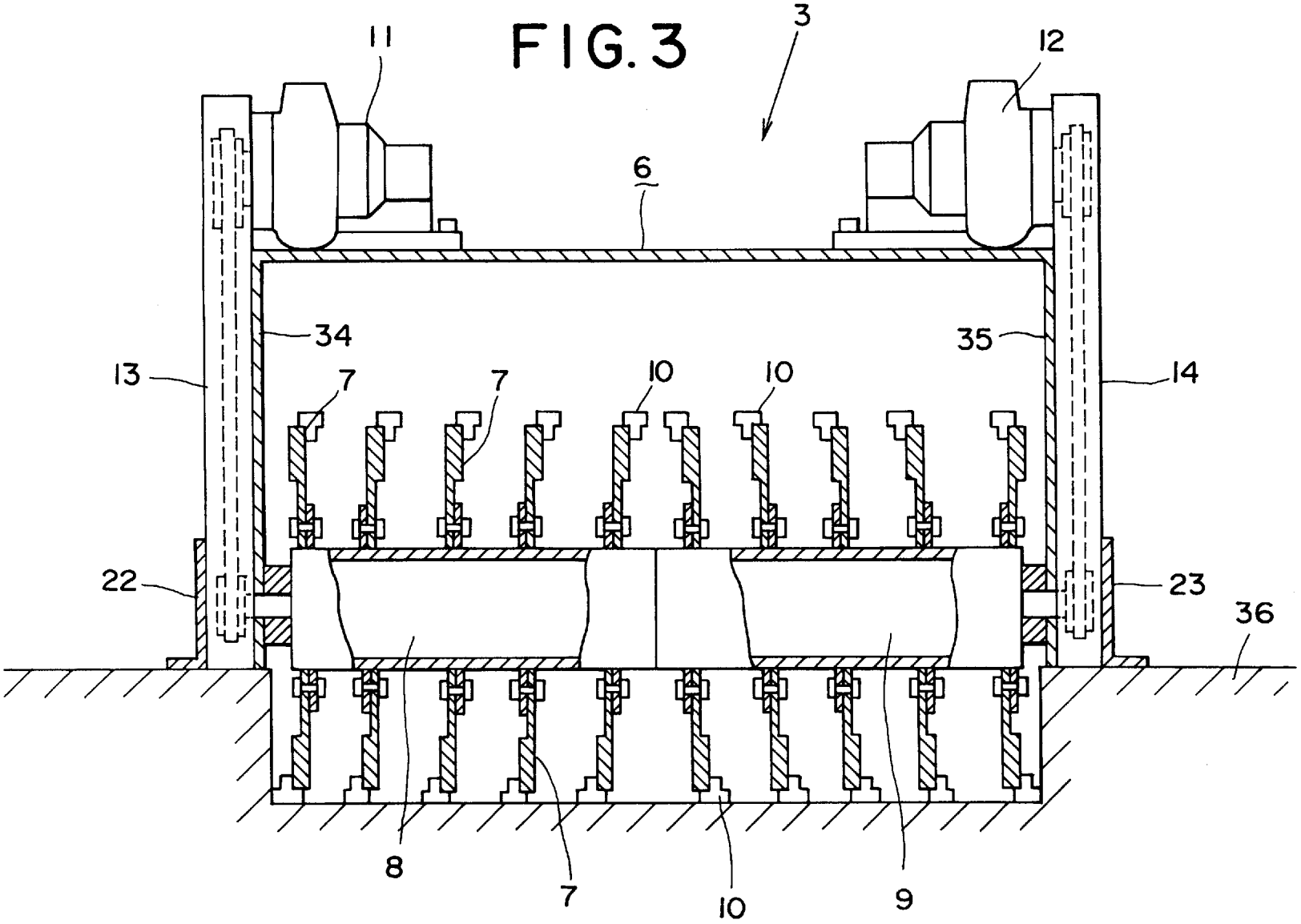
FIG. 3 is a longitudinal sectional front view of the stabilizer.
Figure 4:
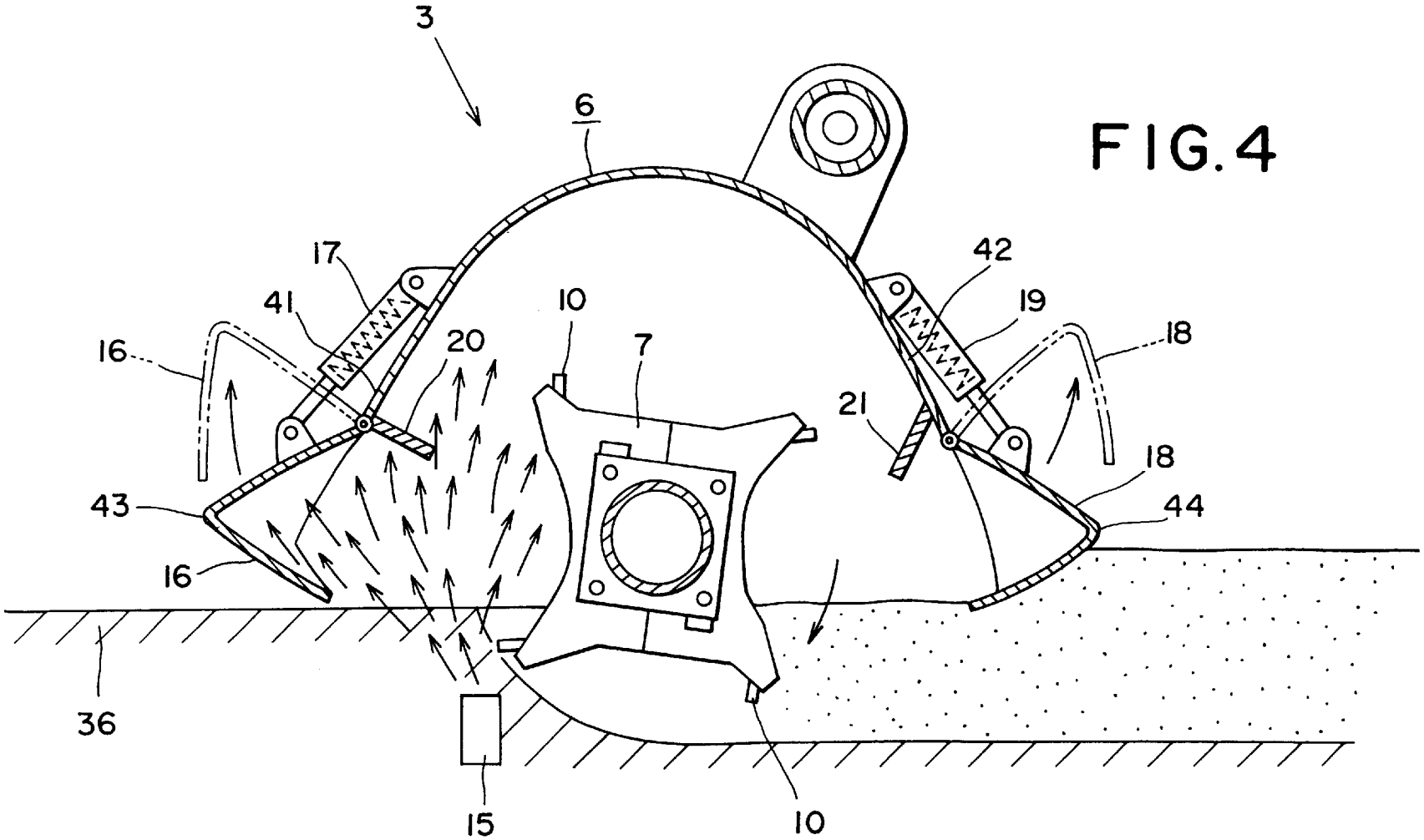
FIG. 4 is a longitudinal sectional side view of the stabilizer.
Figure 5:
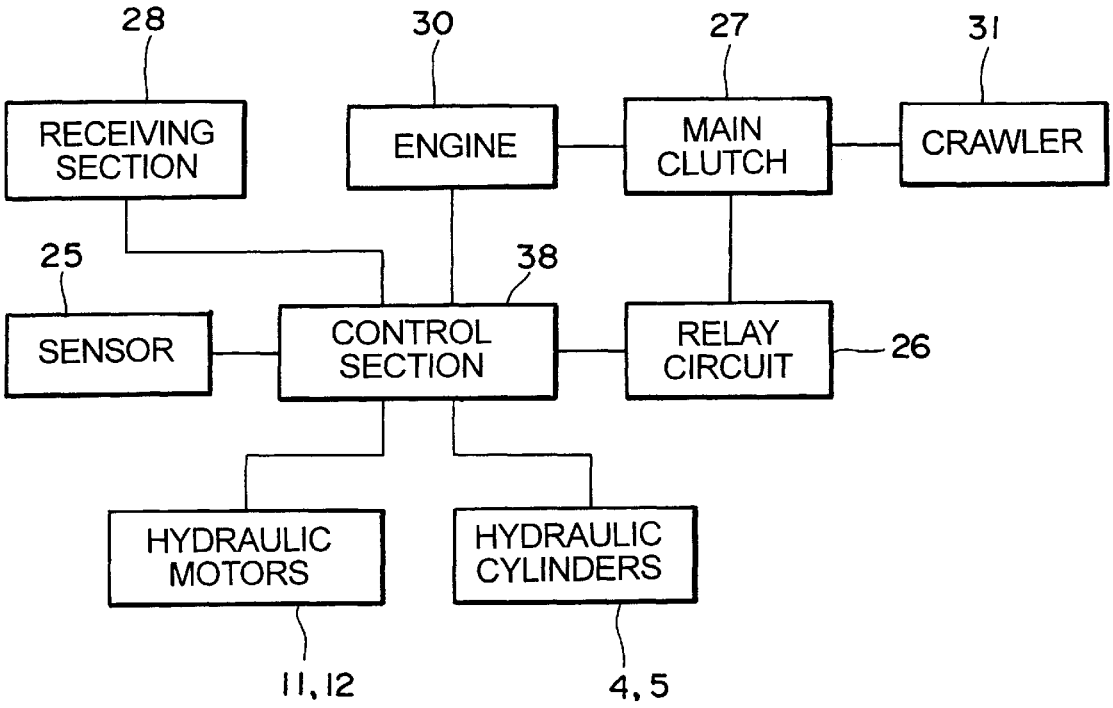
FIG. 5 is a block circuit diagram.

As shown in FIGS. 3, 4, the stabilizer 3 has a pair of rotational shafts 8, 9 extending in a lateral direction of the body 37 and a plurality of soil pulverizing rotor disks or plates 7 removably attached to the rotational shafts 8, 9. Upper half of the rotor disks 7 are covered by an elongated semi-cylindrical metal cover or shield 6 having side metal plates 34, 35. A plurality of removable bits 10 are attached to a periphery of each of the rotor disks 7. The rotational shaft 8 is connected, through a transmission device 13 fixed to an outer surface of the side plate 34, to a hydraulic motor 11 mounted on an outer surface of the shield 6. And also, the rotational shaft 9 is connected, through a transmission device 14 fixed to an outer surface of the side plate 35, to a hydraulic motor 12 mounted on an outer surface of the shield 6. The width of the stabilizer 3 is equal to or longer than that of the body 37 so that the tractor 1 can advance on the pulverized or cultivated land which is safe from antipersonnel mines as described later.

The tractor 1 is controlled by a control signal from a remote control transmitter 29. The control signal is received at a receiving section 28 equipped on the body 37. The tractor 1 advances, while pulverizing the land 36 by the rotor disks 7. To the outer sides of the transmission devices 13, 14 are fixed sleds 22, 23 which determine the depth of pulverizing soil with the rotor disks 7 by touching the surface of the land 36. The depth of pulverizing soil is preferably 40 to 60 cm. Because almost all the antipersonnel mines had been laid within the said depth.

To the front of the stabilizer 3, a sensor or a metal detector 25 is attached for detecting an antitank mine 24 laid under the ground in the land 36. The sensor 25 is arranged to be able to scan at least the area corresponding to the breadth of the stabilizer 3 (tractor 1). When a detection signal from the sensor 25 is outputted to a control section 38 of the tractor 1, the control section 38 cuts off (i.e. disengages) a main clutch 27 between the engine 30 and the crawler 31 through a relay circuit 26, and stops the advance of the tractor 1, keeping the engine 30 idling. The antitank mine 24 detected by the sensor 25 is disposed by a previous traditional method. When the disposal of the mine 24 has been finished, the tractor 1 is advanced again by the remote control transmitter 29.

Since the antitank mine 24 has a strong explosive power which may give a serious damage to the stabilizer 3, it is removed before the rotor disks 7 touch the antitank mine 24 as described above. However, the explosive power of the antipersonnel mine 15 is relatively weak so that the antipersonnel mine 15 can be disposed by blowing it up by the contact with the rotor disks 7. Therefore, the stabilizer 3 of the present invention is arranged so as to be able to bear the blast of the antipersonnel mine 15. That is, each distance between the rotor disks 7 is made to be a distance sufficient for the blast and the scattered objects to smoothly pass through. Furthermore, movable skirts 16, 18 for lessening the blast of the antipersonnel mine 15 are attached to lower ends of front and rear panels 41, 42 of the shield 6 by shaft 39, 40, respectively. The movable skirts 16, 18 are held at positions shown by solid lines in FIG. 4 with shock absorbers 17, 19. The movable skirts 16, 18 are bent and top portions 43, 44 thereof face the outside. When the antipersonnel mine 15 explodes, the movable skirts 16, 18 are opened outside as shown by dotted lines against resilient forces of the shock absorbers 17, 19 by the blast so as to soften the blast acting on the stabilizer 3. By the above mentioned arrangement, the stabilizer 3 of the present invention comes to be able to bear the blast of the antipersonnel mine 15.

The shield 6 has a front breaking board 20 extending substantially backward from an inner surface of the front panel 41 and a rear breaking board 21 extending substantially forward from an inner surface of the rear panel 42. The cakes of soil or the like raked up by the rotor disks 7 are crushed by colliding with the breaking boards 20, 21 and the diameter of the crushed soil or the like is made to be approximately not more than 30 mm.

OPERATION

When a control signal transmitted to the tractor 1 by the remote control transmitter 29 is received at the receiving section 28, the control section 38 starts the engine 30, rotates the rotor disks 7 by the hydraulic motors 11, 12, and lowers the stabilizer 3 by the hydraulic cylinders 4, 5 so as to pulverize the land 36. When the sleds 22, 23 touch the surface of the land 36, the depth of pulverizing soil is kept constant. In that state, when the main clutch 27 is connected so as to transmit the power of the engine 30 to the crawler 31, the tractor 1 advances, while digging up the land 36 by a depth of approximately 40 to 60 cm, by using the rotor disks 7 and the bits 10. At that time, the relatively large cakes of the soil or the like raked up by the rotor disks 7 collide against the front breaking board 20 to be secondarily broken, and after that, they collide against the rear breaking board 21 to be thirdly broken. Furthermore, most of the thirdly broken cakes are returned to the rotor disks 7 again to be fourthly broken. Thus, even in a large cake, the diameter of the broken soil is made to be approximately not more than 30 mm. Accordingly, the land 36, after the tractor 1 has passed, becomes in a cultivated state and it becomes easy to revive the land 36 as a farmland.

When the stabilizer 3 approaches a position above the antipersonnel mine 15 laid under the ground in the land 36, the antipersonnel mine 15 is exploded by the shock of pulverizing or the contact with the rotor disk 7, and then the blast of the mine 15 and scattered objects smoothly pass through the gaps between the rotor disks 7 to collide with the inner surface of the shield 6, and almost all energy of the blast is absorbed and cut off by the shield 6. If the blast is strong, the movable skirts 16, 18 are opened outside against the resilient forces of the shock absorbers 17, 19 to soften the blast acting on the shield 6. Although the movable skirts 16, 18 are opened outside, the cakes of soil and the broken pieces of the mine collide with the inner surfaces of the bent movable skirts 16, 18, so that they may be prevented from scattering far away.

If the antipersonnel mine 15 is laid in a position of a depth of over 60 cm, the pulverizing depth should be increased.

When the antitank mine 24 with a strong power of explosion is laid in the land 36, before the rotor disks 7 approach the antitank mine 24, the sensor 25 detects the antitank mine 24. Then, the control section 38 operates the relay circuit 26 on the basis of the signal from the sensor 25, and cuts off the main clutch 27, and stops the advance of the tractor 1 so that the antitank mine 24 may not go off, and in that state, the antitank mine 24 is removed by hand.

As mentioned above, in the present invention, the disposal device can be manufactured by attaching the stabilizer 3 to the tractor 1, so that the manufacturing costs can be held low. Further, since the tractor 1 is made to run by a remote control, the disposal of the mine can be safely performed. Moreover, since the antipersonnel mine 15 is sought while pulverizing the land 36 by the rotor disks 7, a sure disposal of the antipersonnel mine 15 can be expected. Furthermore, the sensor 25 for detecting the antitank mine 24 is attached in front of the stabilizer 3, so that the antitank mine 24 can be detected, before the rotor disks 7 touch the antitank mine 24.

Further, in the present invention, since the height and the angle of the stabilizer 3 can freely be adjusted by the hydraulic cylinders 4, 5, the maintenance and repairing of the stabilizer 3 can easily be performed.

Moreover, since movable skirts 16, 18 are attached to the shield 6 of the stabilizer 3, it can be prevented that the stabilizer 3 receives a serious damage by the blast of the antipersonnel mine 15. Furthermore, the movable skirts 16, 18 are bent such that the top portions 43, 44 thereof face the outside, so that it is well prevented that the cakes of soil and the broken pieces of the mine are directly scattered to the outside even if the movable skirts 16, 18 are opened to the outside by the blast.

Furthermore, since the sleds 22, 23 are attached to the shield 6 of the stabilizer 3, the depth of the soil breaking by the rotor disks 7 can be kept to be constant, and the omission of the disposal of the antipersonnel mine 15 can be prevented.

Furthermore, since the breaking boards 20, 21 are attached to the inner surface of the shield 6, the cakes of soil or the like are well broken, and it becomes easy to revive the land as a farmland.

What is claimed is:

1. A mine disposal device comprising:

a tractor having an engine and a crawler rotated by a power of the engine;

a supporting arm rotatably attached to a body of the tractor and projecting ahead of the body;

a stabilizer attached to a front end of the supporting arm;

a hydraulic cylinder mounted between the supporting arm and the body for moving the stabilizer substantially in a vertical direction;

said stabilizer having a rotational shaft extending in a lateral direction of the body, a plurality of soil pulverizing rotor disks attached to the rotational shaft and lined at predetermined gaps, a solid semi-cylindrical shield covering the upper half of the rotor disks, and a hydraulic motor for rotating the rotational shaft;

a front movable skirt rotatably attached to a lower end of a front panel of the shield;

a front shock absorber having one end attached to an outer surface of the front panel and the other end attached to the front movable skirt for permitting the front movable skirt to open forward when a strong external force acts on an inside surface of the front movable skirt;

a rear movable skirt rotatably attached to a lower end of a rear panel of the shield;

a rear shock absorber having one end attached to an outer surface of the rear panel and the other end attached to the rear movable skirt for permitting the rear movable skirt to open backward when a strong external force acts on an inside surface of the rear movable skirt;

a remote control transmitter;

a receiving section mounted on the body for receiving a control signal transmitted from said transmitter; and a control section mounted on the body for controlling the engine, the hydraulic cylinder, and the hydraulic motor on basis of a control signal received by the receiving section;

wherein when an antipersonnel mine laid in a land is exploded by a contact with the rotor disks, said front and rear movable skirts are opened forward and backward by a blast of the antipersonnel mine against resilient forces of the front and rear shock absorbers, respectively.

2. A mine disposal device according to claim 1, wherein each of said front and rear movable skirts is bent such that a top portion thereof faces the outside of the shield.

3. A mine disposal device according to claim 2, wherein a pulverizing range of said rotor disks is equal to or longer than a breadth of the body.

4. A mine disposal device according to claim 3, wherein said shield has a sled which touches a surface of the land to keep the depth of soil pulverizing of the rotor disks to be constant when the stabilizer is lowered by action of the hydraulic cylinder.

5. A mine disposal device according to claim 4, wherein said shield has a front soil breaking board extending substantially backward from an inner surface of the front panel of the shield.

6. A mine disposal device according to claim 5, wherein said shield has a rear soil breaking board extending substantially forward from an inner surface of the rear panel of the shield.

7. A mine disposal device according to claim 6, further comprising a sensor mounted to a front portion of the stabilizer for detecting an antitank mine, wherein said sensor scans at least an area where the rotor disks performs soil crushing.

8. A mine disposal device according to claim 7, further comprising a clutch for transmitting a power of the engine to the crawler, wherein said control section stops advance of the tractor by disengaging the clutch when the sensor detects the antitank mine.

9. Method for disposing a mine by using a tractor which has a stabilizer provided in a front side of the tractor and a sensor provided a front side of the stabilizer for detecting an antitank mine, wherein said stabilizer has a plurality of rotor disks for pulverizing a land through a predetermined breadth, a solid semi-cylindrical shield covering the upper half of the rotor disks, a front movable skirt rotatably attached to a lower end of a front panel of the shield, a front shock absorber having one end attached to an outer surface of the front panel and the other end attached to the front movable skirt for permitting the front movable skirt to open forward when a strong external force acts on an inside surface of the front movable skirt, a rear movable skirt rotatably attached to a lower end of a rear panel of the shield, and a rear shock absorber having one end attached to an outer surface of the rear panel and the other end attached to the rear movable skirt for permitting the rear movable skirt to open backward when a strong external force acts on an inside surface of the rear movable skirt; said method comprising:

making the tractor run by a remote control in the land where a mine may be laid while the land is pulverized by the rotor disks by a predetermined depth;

stopping running of said tractor automatically when the sensor detects the antitank mine in the land where the rotor disks has not yet pulverized, and after that, disposing the detected antitank mine without giving a damage to the tractor; and making an antipersonnel mine laid in the land explode by a contact with the rotor disks, and absorbing and cutting off a part of energy of a blast of the antipersonnel mine by the shield, and diffusing the rest of the energy outside of the stabilizer by such a way that the front movable skirt and the rear movable skirt open forward and backward against resilient forces of the front shock absorber and said rear shock absorber, respectively.

* * * * *